US006566818B1

(12) United States Patent
Lin et al.

(10) Patent No.: US 6,566,818 B1
(45) Date of Patent: May 20, 2003

(54) HIGH-EFFICIENCY AND LIGHT-ADJUSTABLE LIGHTING MEANS OF TWO-ELECTRODE LAMP

(76) Inventors: Tieng-fu Lin, No. 5, Alley 23, Lane 48, Chung-Kang Road, Hsin-Chuang, Taipei Hsien (TW); Eongen Yan, No. 228, Chung-San Road, Sec. 2, Chang-Hua City (TW)

( * ) Notice: Subject to any disclaimer, the term of this patent is extended or adjusted under 35 U.S.C. 154(b) by 0 days.

(21) Appl. No.: 10/057,045

(22) Filed: Jan. 22, 2002

(51) Int. Cl.[7] ..... H05B 37/00
(52) U.S. Cl. ..... 315/105; 315/171; 315/173
(58) Field of Search ..... 315/105, 171, 315/173

(56) References Cited

U.S. PATENT DOCUMENTS 4,394,603 A * 7/1983 Widmayer ..... 315/311

* cited by examiner

*Primary Examiner*—David Vu

(57) ABSTRACT

A lighting and starting device for two-electrode lamp includes a plurality of voltage-multiplier rectifying circuits parallelly connected to two electrodes of the lamp with stepping voltages, for instance, high, medium and low voltage levels, whereby upon selection of the desired voltage level, the light of the lamp can be adjusted optimumly.

1 Claim, 3 Drawing Sheets

HIGH-EFFICIENCY AND LIGHT-ADJUSTABLE LIGHTING MEANS OF TWO-ELECTRODE LAMP

BACKGROUND OF THE INVENTION

A conventional fluorescent lamp has the following disadvantages:

1. When starting the conventional fluorescent lamp, a high current must be applied to heat the lamp filaments to easily blacken the tube to ultimately fail.
2. The electromagnetic waves caused from the high frequency induction coil for starting the fluorescent lamp is hazardous to human health.
3. The lamp is not adjustable for varying the illumination or light intensity, being unsatisfactory for the lamp user.

The present inventor has found the drawbacks of conventional fluorescent lamp and invented the present device for obtaining a two-electrode lamp having high efficiency and being adjustable for lamp.

SUMMARY OF THE INVENTION

The object of the present invention is to provide a lighting device for two-electrode lamp including a plurality of voltage-multiplier rectifying circuits parallelly connected to two electrodes of the fluorescent lamp with stepping voltages, for instance, high, medium and low voltage levels, whereby upon selection of the desired voltage level, the light of the fluorescent lamp can be adjusted optimumly.

Another object of the present invention is to provide a protective device to limit current or to prevent from over current as fed back by the reverse voltage from the lamp and led to the lighting circuit of the two-electrode lamp.

DETAILED DESCRIPTION

Figure 1:
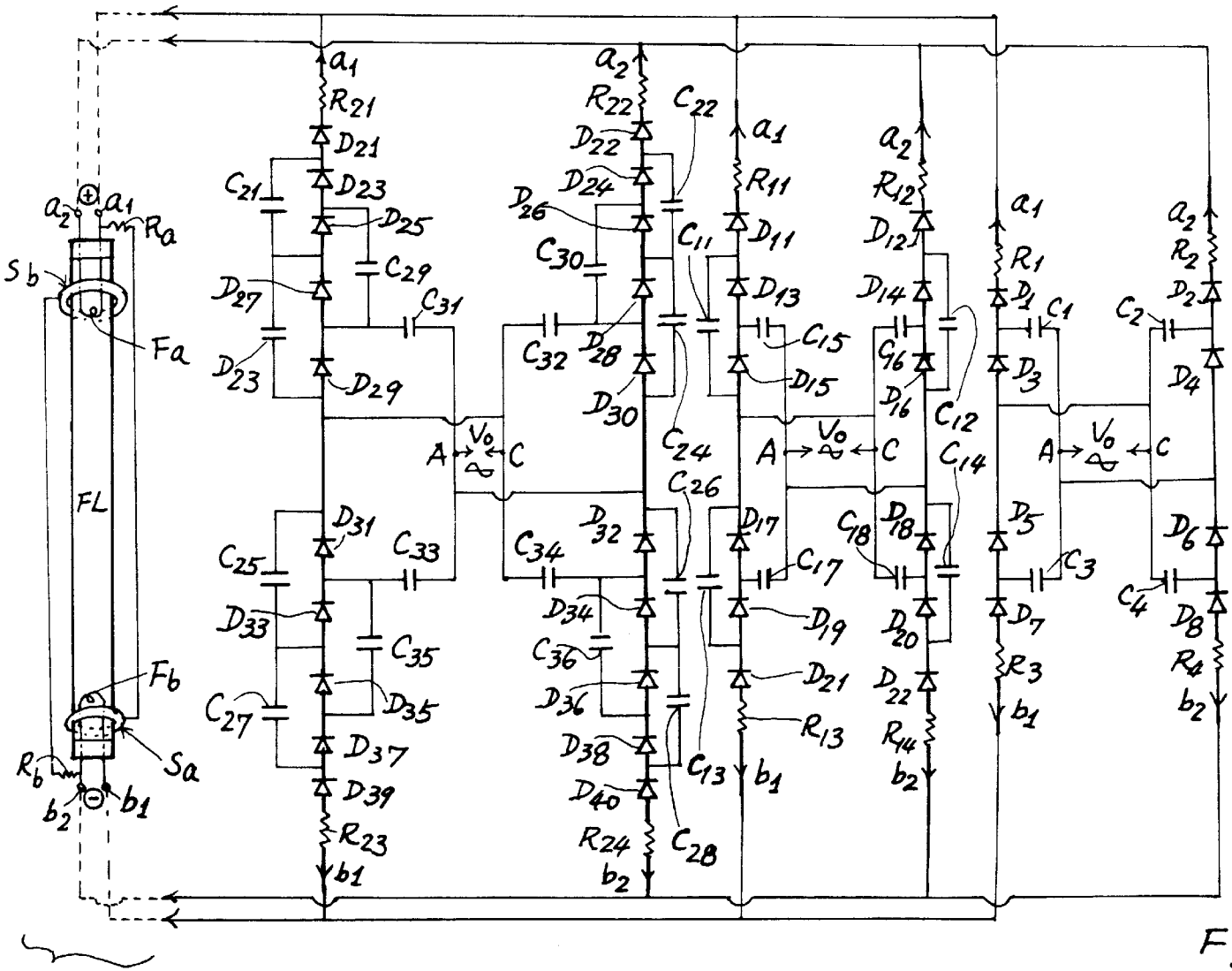
FIG. 1 shows a circuit diagram of the present invention.

As shown in the drawing figures, a preferred embodiment of the present invention comprises a plurality of (or three) voltage-multiplier rectifying circuits $Ckt_1$, $Ckt_2$ and $Ckt_3$ parallelly connected across two electrodes of a fluorescent lamp FL.

Figures 2, 3, 4:
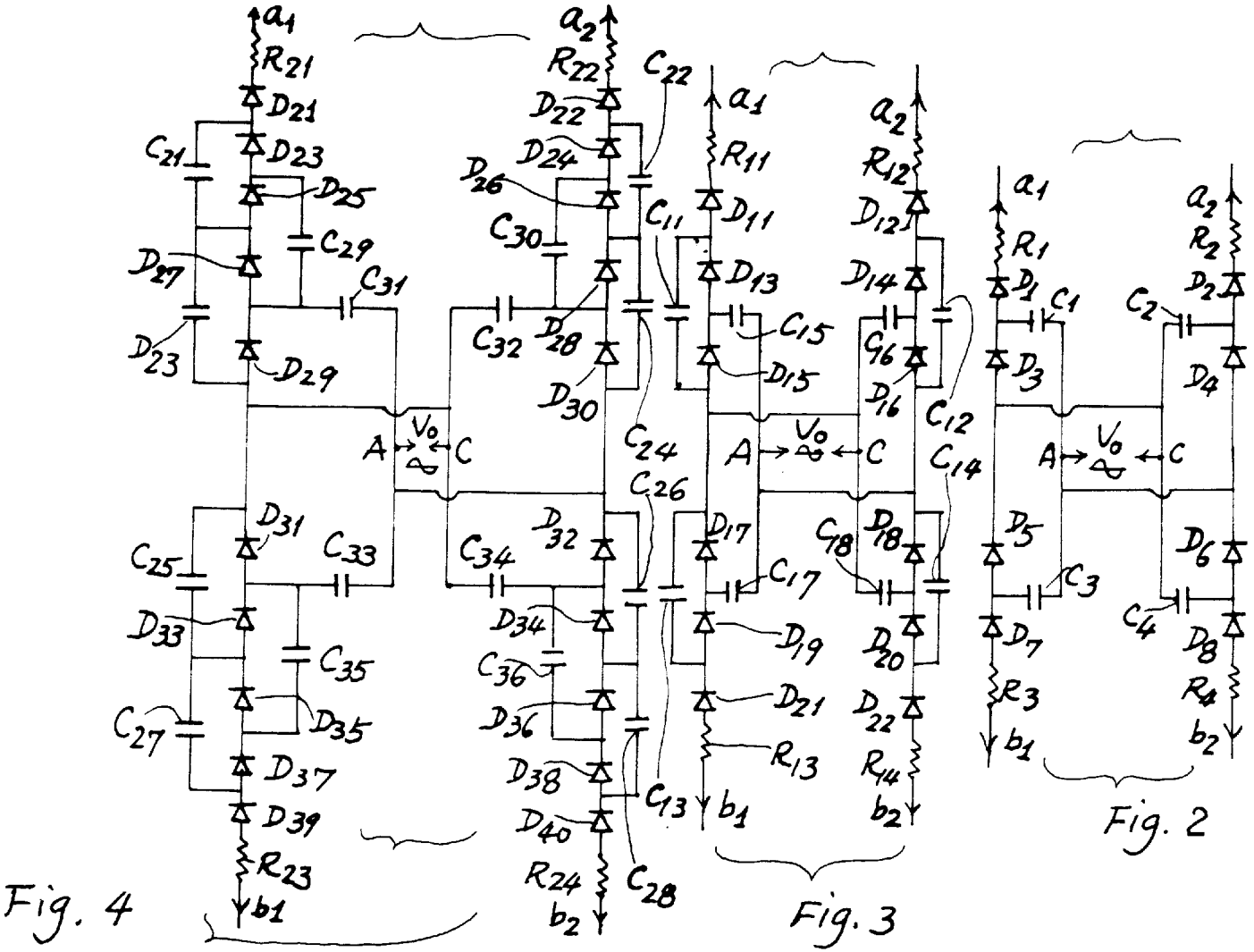
FIG. 2 shows a double-voltage rectifying circuit as included in the present invention.
FIG. 3 shows a quadruple-voltage rectifying circuit existing in the present invention.
FIG. 4 shows an octa-voltage rectifying circuit in the present invention.

As shown in FIG. 2. The first voltage-multiplier rectifying circuit $Ckt_1$ of full-wave bridge type rectifier is described hereinafter.

An alternative current (AC) power source supply having voltage $V_0$ is applied to the circuit $Ckt_1$ through points A and C. The operation principles are shown as follows:

First Cycle

When point A meets a positive half cycle of voltage $V_0$ and point C meets a negative half cycle, the diode $D_3$ is conducted ($D_5$ is interrupted) and the capacitor $C_1$ is charged up to the voltage $V_0$. Meanwhile, when point A meets the positive half cycle of voltage $V_0$ and point C meets negative half cycle of voltage $V_0$, the diode $D_6$ is conducted ($D_4$ is interrupted) and the capacitor $C_4$ is charged up to voltage $V_0$.

During the positive and negative alternation, the positive electricity as charged to the capacitor $C_1$ will be discharged through diode $D_1$ and resistor $R_1$ and output through a first contactor $a_1$ of a first electrode (or positive electrode) of the fluorescent lamp FL (FIG. 1), and the negative electricity will be output through diode D6, diode D8, resistor R4 and a second contactor b2 of a second electrode (or negative electrode) of the fluorescent lamp FL. Meanwhile, the positive electricity charged to the capacitor $C_4$ will be discharged through diode $D_3$, diode $D_1$ and resistor $R_1$ and output through the first contactor $a_1$ of the first electrode of the lamp FL; and the negative electricity thereof is output through diode $D_8$, resistor $R_4$ and the second contactor $b_2$ of the second electrode of the lamp FL.

Second Cycle

When point A meets a negative half cycle of the voltage $V_0$, and point C meets a positive half cycle of voltage $V_0$, the diode $D_4$ is conducted ($D_6$ is interrupted) and the capacitor $C_2$ is charged up to the voltage $V_0$. Meanwhile, when point A meets the negative half cycle and point C meets positive half cycle, the diode $D_5$ is conducted ($D_3$ interrupted) and the capacitor $C_3$ is charged up to the voltage $V_0$.

During the alternation, the positive electricity as charged to the capacitor $C_2$ will be discharged through diode $D_2$ and resistor $R_2$ and output through the second contactor $a_2$ of the first electrode of the lamp FL, and the negative electricity is output through diode $D_5$, diode $D_7$ and resistor $R_3$ and output through the first contactor $b_1$ of the second electrode (or negative electrode) of the lamp FL. Meanwhile, the positive electricity charged to the capacitor $C_3$ will be discharged through diode $D_4$, diode $D_2$ and resistor $R_2$ and output through the second contactor $a_2$ of the first electrode of the lamp FL, and the negative electricity will be output through the diode $D_7$ and resistor $R_3$ and output through the first contactor $b_1$ of the second electrode of the lamp FL.

Accordingly, the contactors $a_1$, $a_2$ of the first electrode of the lamp FL are connected in parallel and the contactors $b_1$, $b_2$ of the second electrode are also connected in parallel to output a voltage of $2V_0$ since capacitors $C_1$, $C_3$ are connected in series, and capacitors $C_2$, $C_4$ are also connected in series.

For calculating a total impedance value $R_x$ of a "loop" of the lighting means as connected with the lamp (having a half-wave internal resistance of $R_{x1}$, $R_{x2}$), the following formula may, for instance, be used:

$$\overline{R}_1=R_1+R_3+\{1\div[2\pi f(C_1+C_3)]\}=R_{x1}$$

$$\overline{R}_2=R_2+R_4+\{1\div[2\pi f(C_2+C_4)]\}=R_{x2}$$

$$R_x=1\div[(1\div R_{x1})+(1\div R_{x2})]$$

The alternation of the positive or negative pulses of an alternative current (AC) power source supply to forwardly conduct diodes and reversely interrupt the diodes and to discharge the capacitors as already being charged to thereby multiply the voltage. For instance, the voltage $V_0$ of power source will be multiplied to be $2V_0$ to eliminate the high frequency induction coil or transformer of a starter as required by a conventional fluorescent lamp. The electromagnetic waves as caused by the high frequency induction coil or transformer of conventional fluorescent lamp will then be prevented in accordance with the present invention, thereby being helpful for human health.

The first rectifying circuit $Ckt_1$ can produce double voltage, i.e., $2V_0$; and the second rectifying circuit $Ckt_2$ (FIG. 3) can produce quadruple voltage, $4V_0$; and the octa-voltage, $8V_0$ will be obtained by the third rectifying circuit $Ckt_3$ (FIG. 4) as hereinafter described.

By selectively connecting either of the rectifying circuits $Ckt_1$ or $Ckt_2$ or $Ckt_3$, three (or plural) multiplied voltage levels can be chosen and applied to the first and second electrodes of the fluorescent lamp FL for adjusting the light intensity of the fluorescent lamp. Namely, $Ckt_1$ (2V) may obtain a high light illumination, $Ckt_2$ (4V) obtaining a medium light, and $Ckt_3$ (8V) obtaining a low light illumination.

As shown in FIG. 3, a second voltage-multiplier rectifying circuit (full-wave bridge type) $Ckt_2$, as parallelly connected to the lamp FL as shown in FIG. 1, is described as hereinafter. $V_0$ is the alternative-current (AC) power source supply, alternatively delivering a positive half cycle and a negative half cycle to the circuit $Ckt_2$ through the point A and point C continuously. The operation principles are described as follows:

First Cycle

When point A is positive and point C is negative, the diode $D_{17}$ is conducted and the capacitor $C_{17}$ is charged to the voltage $V_0$. When point A is negative and point C is positive, the diode $D_{17}$ is interrupted and the diode $D_{19}$ is conducted to charge the capacitor $C_{17}$ to the voltage $V_0$ which is added on the voltage $V_0$ of power source supply to further charge the $C_{13}$ to be $2V_0$ ($V_0+V_0=2V_0$).

During the alternation of positive and negative electricity, the positive electricity of $C_{13}$ is discharged through the first contactor $a_1$ of the first electrode of the lamp FL through $D_{15}$, $D_{13}$, $D_{11}$ and $R_{11}$ and the negative electricity of $C_{13}$ is discharged through the second contactor $b_1$ of the second electrode of the lamp FL through $D_{21}$, $R_{13}$.

Meanwhile, when point A is positive and point C is negative, $D_{16}$ is conducted and $C_{16}$ is charged to the voltage $V_0$. When point A is negative and point C is positive, $D_{16}$ is interrupted and $D_{14}$ is conducted to charge $C_{16}$ to the voltage $V_0$ which is added on with the voltage $V_0$ of power source supply to further charge $C_{12}$ to be $2V_0$. During the alternation of positive and negative electricity, the positive electricity of $C_{12}$ is discharged through $a_2$ of the lamp FL through $D_{12}$, $R_{12}$ and the negative electricity is discharged through $b_2$ of lamp FL through $D_{18}$, $D_{20}$, $D_{22}$ and $R_{14}$.

Second Cycle

When point A is negative and point C is positive, $D_{15}$ is conducted and $C_{15}$ is charged to $V_0$. When point A is positive and point C is negative, $D_{15}$ is interrupted and $D_{13}$ is conducted to charge $C_{11}$ to be 2V which is obtained by the voltage $V_0$ of $C_{15}$ plus the voltage $V_0$ of power source. During the alternation of the positive and negative electricity, the positive electricity of $C_{11}$ is discharged through $a_1$ of lamp FL through $D_{11}$, $R_{11}$, and the negative electricity discharged through $b_1$ of lamp FL through $D_{17}$, $D_{19}$, $D_{21}$ and $R_{13}$.

Meanwhile, when point A is negative and point C is positive, $D_{18}$ is conducted and $C_{18}$ is charged to voltage $V_0$. When point A is positive and point C is negative, $D_{18}$ is interrupted and $D_{20}$ is conducted to charge $C_{18}$ to $V_0$ which is added with $V_0$ of power source to further charge $C_{14}$ to be $2V_0$. During the alternation of positive and negative electricity, the positive electricity of $C_{14}$ is discharged through $a_2$ of lamp FL through $D_{16}$, $D_{14}$, $D_{12}$ and $R_{12}$, and the negative electricity discharged through $b_2$ of FL through $D_{12}$, $R_{14}$.

By the way, $C_{11}$ is connected in series with $C_{13}$ to obtain $4V_0$ ($2V_0+2V_0=4V_0$); while $C_{12}$ is connected with $C_{14}$ in series to obtain $4V_0$ to obtain a quadruple voltage ($4V_0$) of the power source when the $a_1$, $a_2$ are parallelly connected and the $b_1$, $b_2$ are also parallelly connected to the lamp FL.

As shown in FIG. 4 of octa-voltage multiplier of full-wave bridge type rectifier connected to points A and C of the AC power source, the first contactor $a_1$ of the first electrode of the lamp FL is connected with the elements including $D_{29}$, $D_{27}$, $D_{25}$, $D_{23}$, $D_{21}$, $R_{21}$, $C_{31}$, $C_{29}$, $C_{23}$ and $C_{21}$; the second contactor $a_2$ connected with $D_{30}$, $D_{28}$, $D_{26}$, $D_{24}$, $D_{22}$, $R_{22}$, $C_{32}$, $C_{30}$, $C_{24}$ and $C_{22}$; the $b_1$ of the second electrode connected with $D_{31}$, $D_{33}$, $D_{35}$, $D_{37}$, $D_{39}$, $R_{23}$, $C_{25}$, $C_{27}$, $C_{33}$ and $C_{35}$; and the $b_2$ connected with $D_{32}$, $D_{34}$, $D_{36}$, $D_{38}$, $D_{40}$, $R_{24}$, $C_{26}$, $C_{28}$, $C_{34}$ and $C_{36}$. When $C_{21}$, $C_{23}$, $C_{25}$, $C_{27}$ are connected in series, $8V_0$ is obtained at $a_1$, $b_1$; and $C_{22}$, $C_{24}$, $C_{26}$, $C_{28}$ connected in series, $8V_0$ is obtained at $a_2$, $b_2$. Therefore an octa-voltage ($8V_0$) can be obtained.

So, multiplier voltage of $2V_0$, $4V_0$ and $8V_0$ can be selected from FIGS. 2, 3, 4 in accordance with the present invention to respectively obtain illumination light intensity of the florescent lamp FL explained as follows:

First Step for Starting or Lighting Lamp

By using the third full-wave voltage-multiplier bridge rectifying circuit $Ckt_3$ of FIG. 4 to parallelly connect $a_1$, $a_2$ to the first electrode of fluorescent lamp FL to supply positive charge to the first electrode of $8V_0$ high voltage and also to parallelly connect $b_1$, $b_2$ to the second electrode of FL to supply negative charge to the second electrode of $8V_0$ voltage, the lamp FL is lighted by reducing the resistance in the lamp tube by the high voltage. However, the current is low so that the first step for lighting the lamp is a low light intensity (or low brightness) illumination.

Second Step for Lighting Lamp

By using the second rectifying circuit $Ckt_2$ as shown in FIG. 3 to connect $a_1$, $a_2$, $b_1$ and $b_2$ respectively to the two electrodes of the lamp FL to apply the medium voltage ($4V_0$) to the lamp, a second step for lighting the lamp at a medium light intensity illumination with medium current which is still higher than the current of first step (by $Ckt_3$) to further reduce the internal resistance in the lamp and thus brighter than that of $Ckt_3$.

Third Step

By using the first rectifying circuit $Ckt_1$ as shown in FIG. 2 to apply the low voltage ($2V_0$) to the lamp FL, a third step for lighting the lamp FL at the brightest level than the second step since maximum current and lowest voltage is applied to the lamp to minimize the internal resistance in the lamp tube.

Therefore the light intensity of the lamp can be adjusted stepwise by selecting the desired rectifying circuit. Naturally, the circuits are not limited to $Ckt_1$, $Ckt_2$ and $Ckt_3$ as aforementioned in accordance with the present invention.

The lower the internal resistance in the lamp tube is, the higher the current in the tube will be, thereby emitting more electrons for strongly ionizing vapor in the tube for glowing the lamp brighter.

As shown in FIG. 1 for showing a starter device, since the first or positive electrode (filament) Fa is far apart from the second or negative electrode (filament) Fb of the lamp FL, an outer negative electrode $S_b$ (which may be an electrically conductive ring or metal ring) is closely disposed about the positive electrode Fa as partitioned by an electrically insulative tube wall of the lamp FL and is connected to the negative electrode Fb by a limiting-current resistor Rb; and an outer positive electrode Sa (which may be an electrically conductive ring or metal ring) is closely disposed about the negative electrode Fb as partitioned by the electrically insulative tube wall of the lamp and is connected to the positive electrode Fa by another limiting-current resistor Ra.

Since each outer electrode Sb or Sa is quite close to the electrode Fa or Fb in the lamp tube by the insulative tube wall to play as a capacitor, the voltage between the outer electrode with the electrode (filament) in the lamp tube will be discharged to have the function of a starter for starting the fluorescent lamp FL.

Accordingly, a conventional starter for boosting the voltage in order to start the fluorescent lamp will be eliminated in accordance with this starter device of the lamp FL as above-mentioned.

Figure 6:
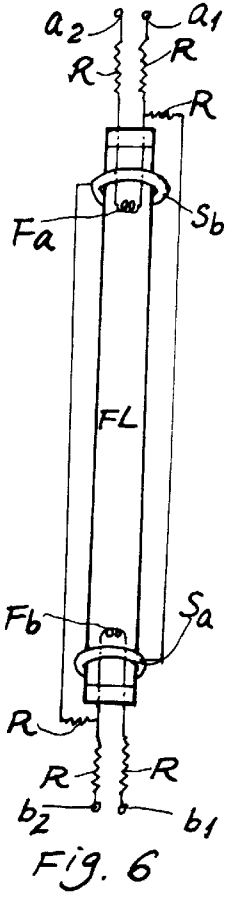
FIG. 6 shows a fluorescent lamp as protected in accordance with the present invention.

As shown in FIG. 6, each contactor $a_1$, $a_2$, $b_1$, $b_2$ is connected to each electrode Fa or $F_b$ by a limiting-current resistor R to limit the current under a safety value in consideration of a "critical impact effect" for protecting the filaments Fa, Fb and the lamp FL, for instance, for preventing from damage and blackening of the tube.

The present invention provides a fluorescent lamp which is light adjustable, safely protected and not hazardous as caused by the electromagnetic wave, thereby serving for convenient, safe and energy-saving use.

Figure 5:
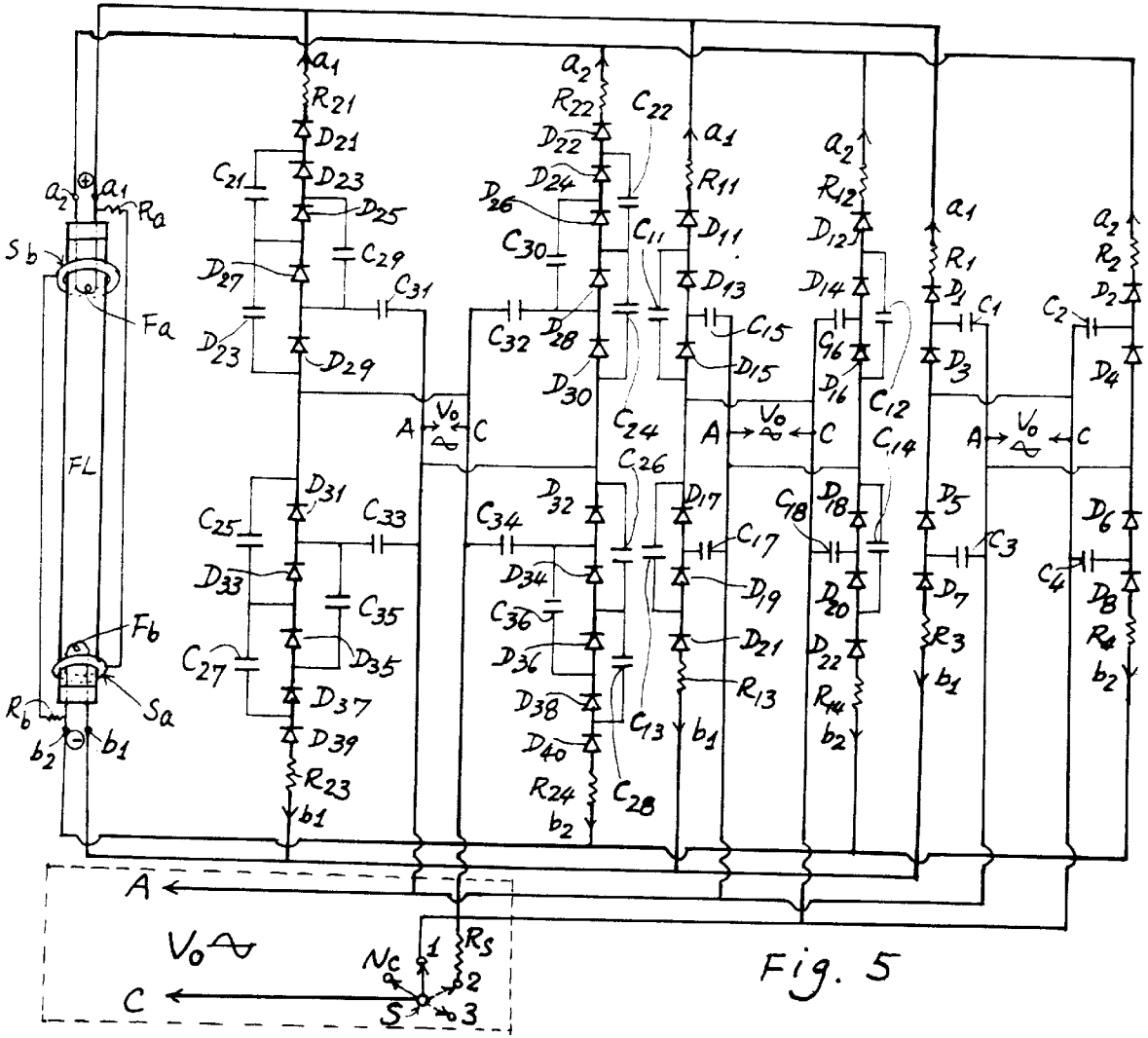
FIG. 5 is an illustration when added with a further light-adjusting device of the present invention.

As shown in FIG. 5, each terminal such as point C (or point A) is selectively connected with a plurality of selecting switches S, for instance, Nc for power off; a first switch (numeral "1") for a first current supply and first light intensity; a second switch (numeral "2") connected with a resistor $R_s$ to the circuit for a second (lower) current supply and second (weak) light intensity. A third switch ("3") may also be added. However, such a switch device is so conventional and can be modified by those of skill in the art.

The present invention may be modified without departing from the spirit and scope of this invention. The voltage multipliers are also not limited to voltage doublers.

The two-electrode lamp of the present invention may refer to a fluorescent lamp, and other two-electrode illuminators.

We claim:

1. A lighting means of two-electrode lamp comprising:

a plurality of voltage-multiplier bridge rectifying circuits selectively and parallelly connected to a positive electrode and a negative electrode of a two-electrode lamp, having stepwise rating of voltage and current values of said rectifying circuits for operatively adjusting a light intensity or brightness of the two-electrode lamp;

each said voltage-multiplier rectifying circuit connected to an alternative-current (AC) power source supply and operatively alternatively forward conducting a plurality of diodes or reversely interrupting a plurality of said diodes, and having a plurality of capacitors connected between said positive and negative electrodes of said lamp and respectively connected to said diodes and alternatively charging or discharging for outputting positive or negative electricity of a multiplied voltage to said positive and negative electrodes for lighting said two-electrode lamp; and a starter device including: an outer negative electrode formed as a first electrically conductive ring and closely disposed about the positive electrode as partitioned by an electrically insulative tube wall of the lamp and connected to the negative electrode by a first limiting-current resistor; and an outer positive electrode formed as a second electrically conductive ring and closely disposed about the negative electrode as partitioned by the electrically insulative tube wall of the lamp and connected to the positive electrode by a second limiting-current resistor; each said outer electrode positioned closely to each said electrode in the lamp tube as partitioned by the tube wall for forming a capacitor operatively charging and discharging for starting the lamp.

* * * * *